United States Patent [19]

Diesch et al.

[11] 4,260,148

[45] Apr. 7, 1981

[54] PHOTOGRAPHIC PRINT STACKING DEVICE

[75] Inventors: Robert E. Diesch, Rogers; Charles L. Eutenuer, St. Michael, both of Minn.

[73] Assignee: Pako Corporation, Minneapolis, Minn.

[21] Appl. No.: 21,091

[22] Filed: Mar. 16, 1979

[51] Int. Cl.[3] ..... B65H 31/14; B65H 31/26

[52] U.S. Cl. ..... 271/219; 271/220; 271/224; 271/314; 271/DIG. 3

[58] Field of Search ..... 271/219, 217, 224, 220, 271/160, 223, 314, 171, DIG. 3, 177, 274, 207; 414/99, 98, 100

[56] References Cited

U.S. PATENT DOCUMENTS

| | | | |
|---|---|---|---|
| 1,928,923 | 10/1933 | Andersen | 271/219 |
| 2,377,525 | 6/1945 | Schutt | 271/274 |
| 2,771,293 | 11/1956 | Guttridge | 271/219 |
| 3,148,879 | 9/1964 | Kistner | 271/224 X |
| 3,425,610 | 2/1969 | Stewart | 271/197 X |
| 3,733,770 | 5/1973 | Erickson et al. | 53/29 |
| 3,789,571 | 2/1974 | Tall et al. | 53/54 |
| 3,797,719 | 3/1974 | Tall et al. | 225/100 |
| 4,007,925 | 2/1977 | DeRyke et al. | 271/160 |
| 4,012,036 | 3/1977 | Sokol | 271/215 |
| 4,114,349 | 9/1978 | Jensen et al. | 53/54 |
| 4,139,978 | 2/1979 | Jensen et al. | 53/167 |
| 4,139,980 | 2/1979 | Larson et al. | 53/520 |

FOREIGN PATENT DOCUMENTS 709218 5/1954 United Kingdom ..... 271/220

OTHER PUBLICATIONS

"Product Digest", Published by Mills-Dycem, Nov. 1977.

Wing, W. F. "Sheet Receiving Tray," *IBM Technical Disclosure Bulletin*, vol. 17, No. 4, Sep. 1974, p. 1135.

*Primary Examiner*—Bruce H. Stoner, Jr.

*Attorney, Agent, or Firm*—Kinney, Lange, Braddock, Westman and Fairbairn

[57] ABSTRACT

A photographic print stacking device is positioned proximate the discharge end of the conveyor system which conveys photographic prints from a photographic print cutter. The print stacking device includes upper and lower print receiving elements, which are yieldably urged toward one another. The lower print receiving element is movable generally downward and away from the upper print receiving element as the prints are deposited on the lower print receiving element. The conveyor system delivers the prints to the stacking device with sufficient force to carry the prints between the upper and lower print receiving elements until their front edges engage a stop element. As a result, the rear edges of the prints are all substantially in alignment at a location proximate the discharge end of the conveyor system. The stop element preferably is releasably latched in an operative upstanding position and may be moved out of the way by the operator when removing an accumulated stack of prints.

28 Claims, 8 Drawing Figures

PHOTOGRAPHIC PRINT STACKING DEVICE

BACKGROUND OF THE INVENTION

1. Field of the Invention

The present invention relates to photographic processing equipment. In particular, the present invention is a print stacking device for stacking individually cut photographic prints.

2. Description of the Prior Art

In commercial photographic processing operations, very high rates of processing need to be achieved and maintained in order to operate profitably. To expedite the photographic processing, orders containing film of similar type and size are spliced together for developing. As many as 500 to 1000 rolls of 12, 20, 24 and 36 exposure film may be spliced together for processing and printing purposes.

After developing, the photographic film contained in the film negatives are printed in an edge-to-edge relationship on a continuous strip of photosensitive paper by a photographic printer. The photographic printer causes high intensity light to be passed through a negative and imaged on the photographic print paper. The photographic emulsion layer on the print paper is exposed and is subsequently processed to produce a print of the image contained in the negative.

After the strip of photographic print paper has been processed to produce prints, a photographic paper cutter cuts individual prints from the strip. The prints are then sorted by customer order, either manually or automatically, and ultimately packaged and sent to the customer.

Automatic print paper cutters have been developed which automatically cut the print paper into individual prints. These automatic paper cutters are controlled by indicia which are placed along the print paper by the photographic printer. Typically the indicia are of two types: cut marks and end-of-order marks. Cut marks indicate the desired location of a cut between adjacent prints. End-of-order marks, which typically appear along the opposite edge of the print paper from the cut marks, indicate the end of a customer's order. The automatic paper cutter includes a sensor which senses the cut marks and causes the individual prints to be cut from the strip at desired locations. The separated prints are passes to an order packaging or grouping device which groups the prints in response to the end-of-order marks which are sensed by the automatic cutter.

The desire for higher rates of processing within commercial photographic processing operations has led to the development of extremely high speed automatic paper cutters. One example of such an automatic paper cutter is described in U.S. Pat. No. 4,128,887 by G. Strunc and F. Laciak, which is assigned to the same assignee as the present application. The automatic paper cutter described in this patent is capable of cutting over 25,000 prints per hour (i.e. over seven prints per second).

Print stacking devices have been developed for stacking the photographic prints which have been cut by the photograph paper cutter. In some cases, these print stacking devices have been an attachment or addition to a photographic paper cutter, while in other cases the print stacking device has been part of an automatic print sorter. In general, these prior art print stacking devices have included means for conveying the photographic print from the paper cutter and depositing the print into an open box or container. The prints are deposited generally one on top of the other to form the stack of prints.

These prior art print stacking devices, however, have not been entirely successful. It has proved difficult to produce a print stacking device which yields uniform stacks of prints which can be quickly and easily handled. Instead, the operator has often been required to rearrange the prints, such as by standing a stack of prints on edge on a flat surface and tapping the prints to align their edges prior to insertion of the prints into a pocket of the customer order envelope. This procedure, of course, is time-consuming and reduces the overall efficiency of handling the photographic prints.

SUMMARY OF THE INVENTION

The present invention is a photographic print stacking device which stacks photographic prints into uniform, easy-to-handle, stacks. In the present invention photographic prints are conveyed by print conveying means from a photographic paper cutter. First and second print receiving elements are positioned proximate the discharge end of the print conveying means to receive and hold the prints as they are discharged. Means are provided for yieldably urging the first and second print receiving elements toward one another. As additional prints are deposited between the first and second print receiving elements, the second print receiving element moves away from the first print receiving element. Stop means are provided at a selected distance from the discharge end for stopping the front edges of the prints as they are deposited between the first and second print receiving elements.

With the print stacking device of the present invention, therefore, control is maintained over the print throughout the conveying and during the delivery of the prints from the discharge end of the conveyor to their final stacking position. This overcomes problems which can occur due to the tendency of the prints to curl.

In the preferred embodiments of the invention, the first print receiving element is a movable foot element and the second print receiving element is a movable platform. The floating foot element has an inclined forward portion which deflects photographic prints downward toward the platform as they are discharged from the discharge end of the conveyor system. The deflecting portion of the floating foot element and the stop means are positioned with respect to the discharge end of the conveyor system such that the rear edges of the prints held between the foot element and the platform do not impede the front edge of the next print which is discharged at the discharge end of the conveyor system.

The present invention preferably utilizes a stop means which is privotally mounted and which is latched in an upstanding position. When the operator desires to remove prints, the stop means may be pivoted out of the way to permit easy removal of the stack of prints.

BRIEF DESCRIPTION OF THE DRAWINGS

FIG. 8 is a sectional view along section 8—8 of FIG. 6 showing the adjustable stop element.

DETAILED DESCRIPTION OF THE PREFERRED EMBODIMENTS

In the following description, the print stacking device of the present invention will be used in conjunction with a photographic print sorter, in which photographic prints are sorted into good, remake, and reject prints. It should be understood, however, that the print stacking device of the present invention may also be used in systems in which the photographic prints are not sorted into various groups, but rather are merely grouped by customer order.

Figure 1:
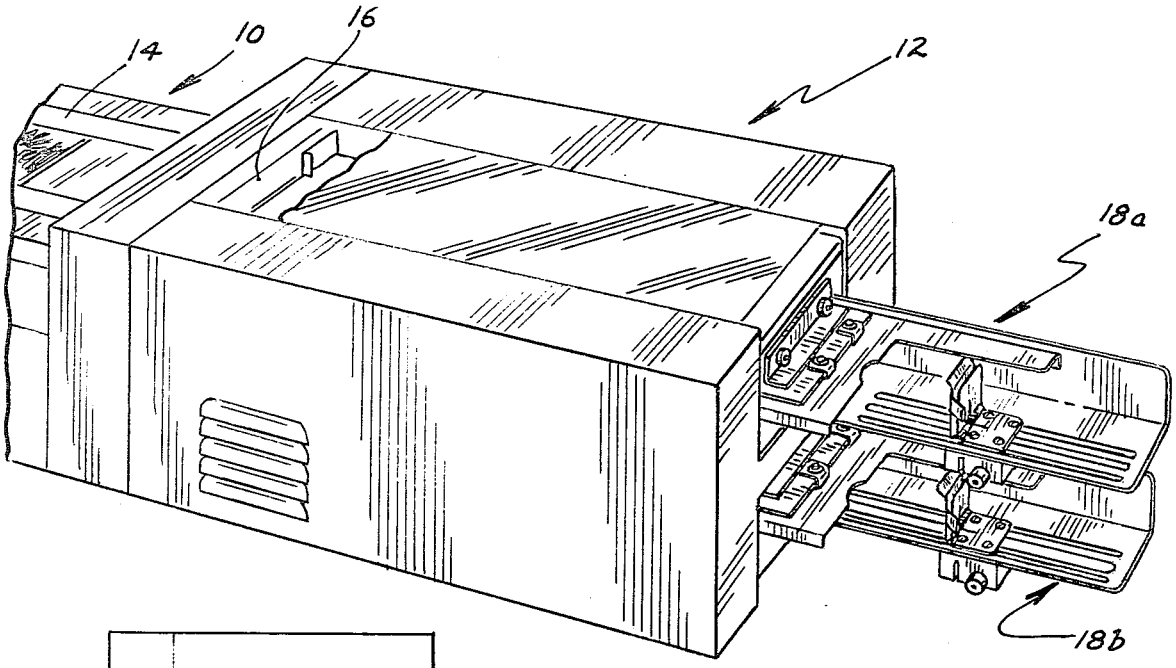
FIG. 1 is a perspective view of a photographic print sorter utilizing the photographic print stacking device of the present invention.

FIG. 1 shows a photographic print cutting and sorting system which includes a photographic print cutter 10 and a print sorter 12. Photographic print cutter 10 may be, for example, an automatic photographic paper cutter such as the Pako PC305 paper cutter, which is described in the previously mentioned U.S. Pat. No. 4,128,887 by G. Strunc and F. Laciak, and which is assigned to the same assignee as the present invention.

Photographic prints are cut from strip 14 by knife assembly 16 of print cutter 10. The cut prints are sorted by print sorter 12 into good, remake, and reject prints. This sorting is done on the basis of remake and reject indicia which are applied to the face of remake and reject prints, respectively, by the operator of the cutter/sorter system. The indicia are sensed by a remake/-reject sensor (not shown) which is located on print cutter 10 near knife assembly 16.

As shown in FIG. 1, print sorter 12 has two print stacking devices of the present invention: good print stacker 18*a* and remake print stacker 18*b*. The "good" prints (which have neither a remake indicium nor a reject indicium) are conveyed by print sorter 12 to good print stacker assembly 18*a*. Remake prints are directed along a different path and conveyed by sorter 12 to remake print stacking assembly 18*b*. The reject prints are driven along still a third path and are either driven out the bottom of sorter 12 and into a wastebasket or the like, or driven and stacked on a third print stacking assembly (not shown).

At the end of each order the operator removes the good and remake prints accumulated at print stacking assemblies 18*a* and 18*b*, respectively, and places the prints into the customer order envelope. The system is then re-started and prints of the next order are sorted and stacked.

Figure 2:
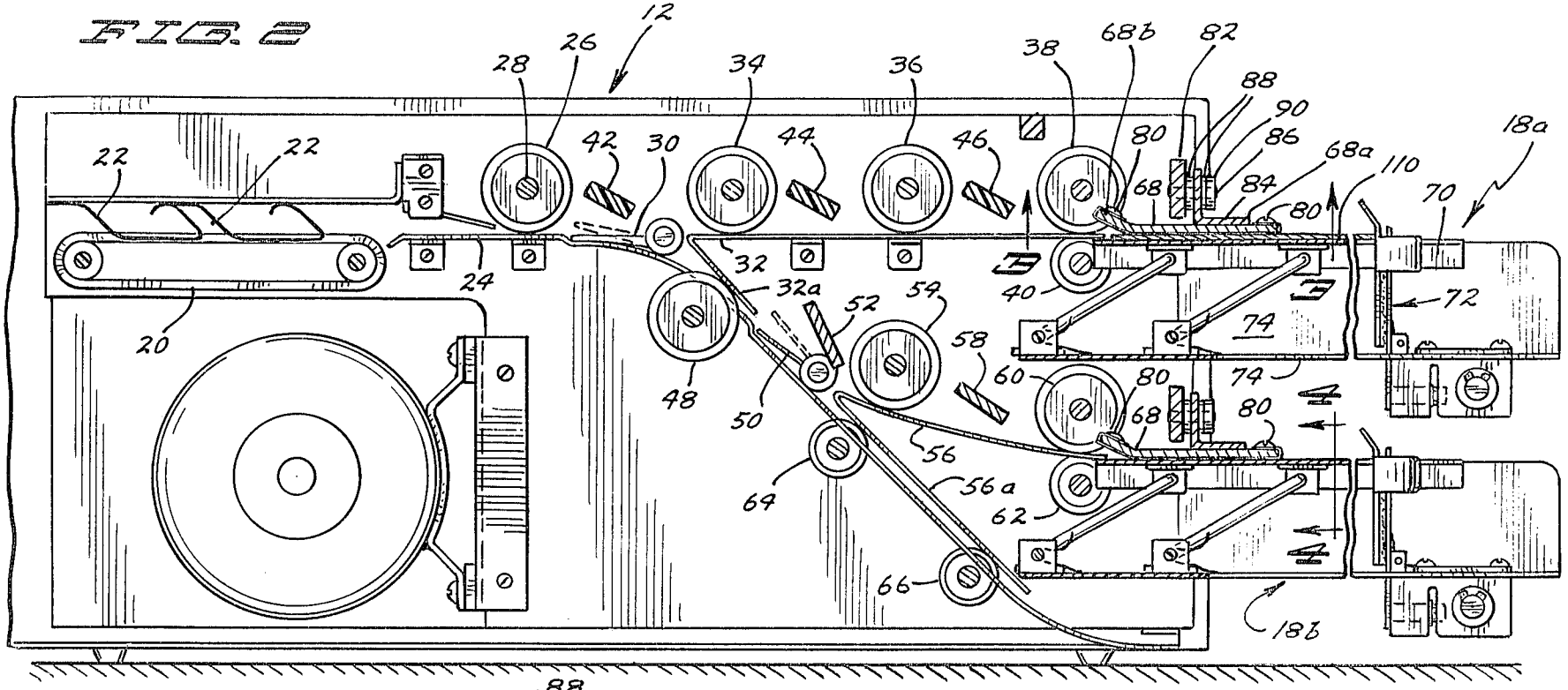
FIG. 2 is a side sectional view of the photographic print sorter of FIG. 1.

FIG. 2 shows a sectional side view of the print sorter of FIG. 1. As will be noted from the following discussion, the print sorting and conveying portions of the print sorter are generally similar to the mechanism shown in U.S. Pat. No. 4,114,349 by G. A. Jensen, L. A. Larson, and R. E. Diesch, which is assigned to the same assignee as the present application.

Photographic prints from print cutter 10 are fed onto a constantly moving conveyor which includes a plurality of O-ring type feed belts 20. The prints are held in contact with feed belts 20 by flexible spring fingers 22.

Feed belts 20 are positioned immediately ahead of the entrance to the main conveyor line. Each print is first driven onto conveyor bed 24, where it is driven by a first set of drive rollers 26, which are driven on a common shaft 28.

Located immediately following drive rollers 26 is movable deflector 30. When the print being conveyed is a "good print," movable deflector 30 is in its downward position shown in solid lines in FIG. 2. In this position, deflector 30 covers the opening to the branch lines for "remake" and "reject" prints and causes the print to be transported over the top surface of deflector 30 to conveyor bed 32 and drive rollers 34. The print continues to be conveyed along the top surface of bed 32 by drive rollers 36 until it reaches the final set of drive rollers 38 at the discharge end of the good print conveyor line. Idler rollers 40 underly drive rollers 38 at the discharge end.

As shown in FIG. 2, stationary inclined deflectors 42, 44 and 46 are positioned along the main conveyor line between successive sets of drive rollers. The downstream edges of deflectors 42, 44 and 46 are more closely spaced to the conveyor bed (24 or 32) than are their upstream edges. If a print is curled or warped, inclined deflectors 42, 44 and 46 tend to force the print downwardly toward the conveyor bed and momentarily straighten the print, thus ensuring positive engagement of the front edge of the print with the next set of rollers. This prevents a curled or warped print from jamming the conveyor line by being driven over rather than under one of the sets of drive rollers.

If the print is a remake or reject print, movable deflector 30 is pivoted to its upper position, as shown in phantom in FIG. 2. In this position, deflector 30 causes the print to be driven downward into the branch conveyor lines for remake and reject prints. The print is first engaged by down-turned portion 32*a* of conveyor bed 32 and is driven generally downward by a set of drive rollers 48.

Second movable deflector element 50 is positioned to direct remake prints along one path and reject prints along another path. In FIG. 2, the position of movable deflector 50 shown in solid lines is for remake prints, while the position of movable deflector 50 shown in phantom is for reject prints.

Remake prints are driven across the top surface of deflector 50, and are deflected downward slightly by inclined stationary deflector 52 and between drive rollers 54 and conveyor bed 56. The print is then deflected by deflector 58 to drive rollers 60 and idler rollers 62 at the discharge end of the remake conveyor line.

When the print is a reject print, movable deflector 50 is pivoted to its upper position shown in phantom in FIG. 2. In this position, deflector 50 causes the reject print to travel down the reject conveyor line defined by conveyor bed 24 and the down-turned portion 56*a* of conveyor bed 56. The reject print is driven by drive rollers 64 and 66 to the bottom of the machine, where it is traveling with sufficient momentum to pass out of the machine and into a wastebasket or the like.

As shown in FIGS. 1 and 2, the good print stacking assembly 18*a* and the remake print stacking assembly 18*b* are identical. For that reason, identical numbers will be used to designate identical elements, and in later Figures only one of the two print stacking assemblies will be shown and described.

Figure 3:
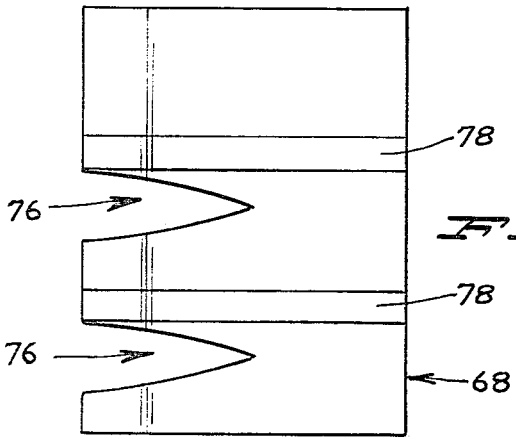
FIG. 3 is a bottom view of the upper foot element along section 3—3 of FIG. 2.

As shown in FIG. 2, each print stacking assembly includes upper movable foot element 68, lower print receiving platform element 70, stop element 72, and a print tray base 74. Upper foot element 68 has a generally planar portion 68*a* and an upwardly inclined guiding portion 68*b* at its receiving end. The upwardly inclined guiding portion 68*b* acts as a deflector to deflect prints generally downwardly toward platform 70 and on to the top of a stack of prints being held between planar portion 68*a* of foot element 68 and the top surface of platform 70. As best shown in FIG. 2, both the deflecting portion 68*b* of foot element 68, and the receiving end of platform 70 are very closely spaced to the discharge end of the conveyor, as defined by drive rollers 38 and idler rollers 40. As best shown in FIG. 3, which is a bottom view of foot element 68, V shaped notches 76 permit the closely spaced positioning of foot element 68 and drive rollers 38 without interference between the front edge of inclined deflector portion 68*b* with drive rollers 38 (or 60).

FIG. 3 also shows two parallel wear strips 78 positioned on the bottom surface of foot element 68. Wear strips 78, which are preferably a low friction material such as nylon or Teflon, minimize friction of the prints against the lower surface of foot element 68. Wear strips 78 present two point contact with the prints and therefore uniform, easily controlled loading. As a result, wear strips 78 eliminate the need to keep the lower surface of foot element 68 and the top surface of platform 70 perfectly flat and parallel. In addition, wear strips 78 minimize the chance of scratching of the surface of the prints during the stacking operation. Wear strips 78 extend over the ends of foot element 68 and onto the top surface, where they are held in place by connectors 80, which may be screws or any other suitable connectors.

Figure 4:
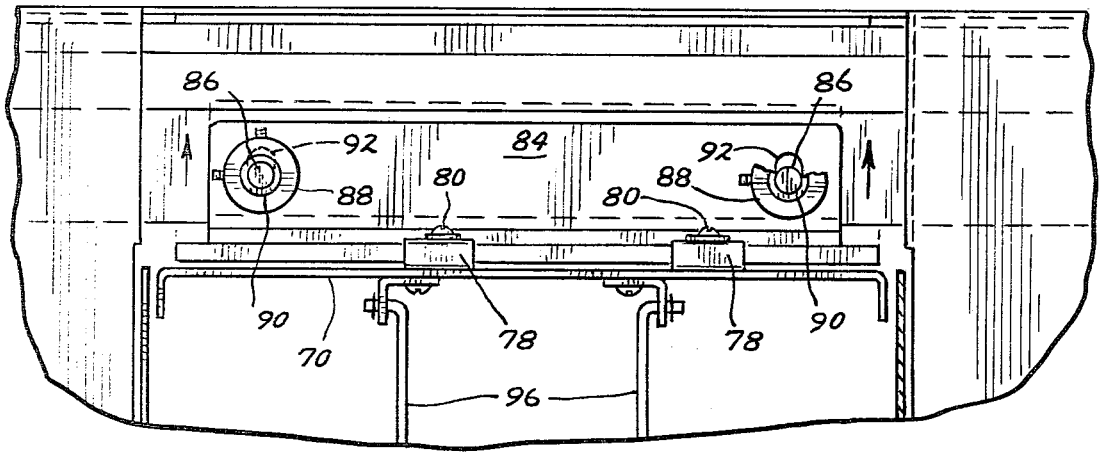
FIG. 4 is a sectional view along section 4—4 of FIG. 3.

Movable foot element 68 is yieldably connected to mounting bar 82 by mounting angle 84, pins 86, washers 88, and retaining rings 90. Mounting angle 84 has its horizontal portion mounted to the top surface of planar portion 68*a* of foot element 68. Pins 86 are attached to bar 82 and extend through elongated slots 92 in the upstanding portion of mounting angle 84 (as best shown in FIG. 4). Elongated slots 92 permit vertical movement of foot element 68. Washers 88 on opposite sides of the upstanding portion of mounting angle 84 and retaining ring 90 limit the horizontal movement of foot element 68 on pins 86. In the preferred embodiments of the present invention, washers 88 and retaining ring 90 are positioned and selected so that a slight rocking motion of foot element 68 is permitted. Allowing foot element 68 to float permits uniform loading (via wear strips 78) against platform 70, thus ensuring straight travel of prints.

Figures 5, 6, 9:
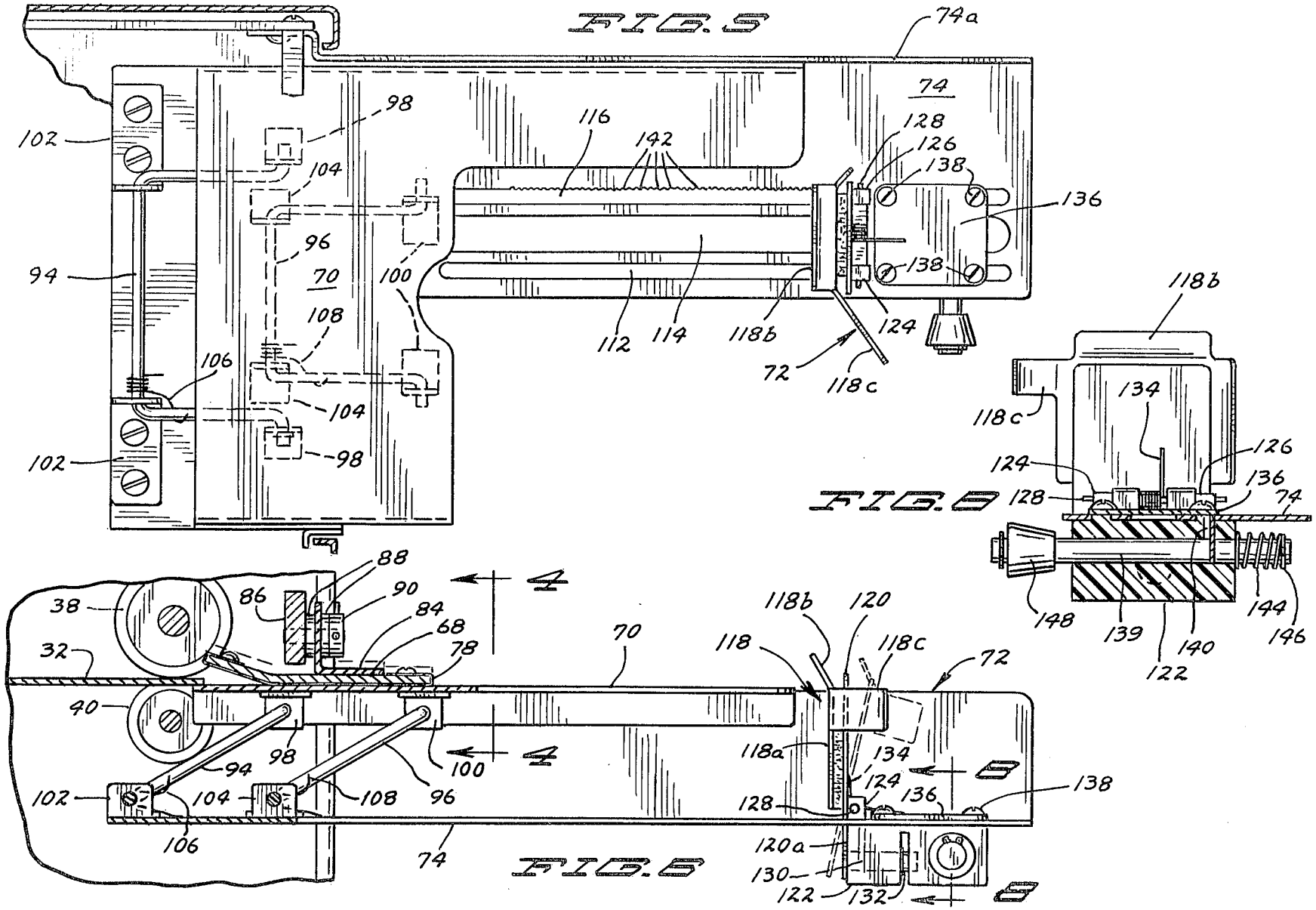
FIG. 5 is a top view showing the lower platform element, the print tray base, and the stop element of the print stacking device of FIG. 1.
FIG. 6 is a detailed sectional view showing the print stacking device of the present invention prior to stacking of photographic prints between the upper foot element and the lower platform element.

FIG. 5 is a top plan view showing lower platform 70, stop element 72, and print tray base 74. As shown in the Figures, platform 70 is pivotally mounted on first and second parallel mounting arm assemblies 94 and 96. Mounting brackets 98 pivotally connect the ends of first arm assembly 94 to the bottom of platform 70. Similarly, brackets 100 pivotally connect the ends of second arm assembly 96 to the bottom of platform 70. First arm assembly 94 is also pivotally connected to print tray base 74 by mounting brackets 102, and second arm assembly 96 is pivotally connected to print tray base 74 by mounting brackets 104. Torsion springs 106 and 108 urge arms 94 and 96, and therefore platform 70, upward toward movable foot element 68. In the preferred embodiments of the present invention, the weight of foot element 68 is sufficient to overcome the force of torsion springs 106 and 108 to establish a rest elevation of platform 70 which is slightly below the plane of the discharge end of the conveyor system, as defined by the final drive and idler rollers 38 and 40 (or 60 and 62).

Figure 7:
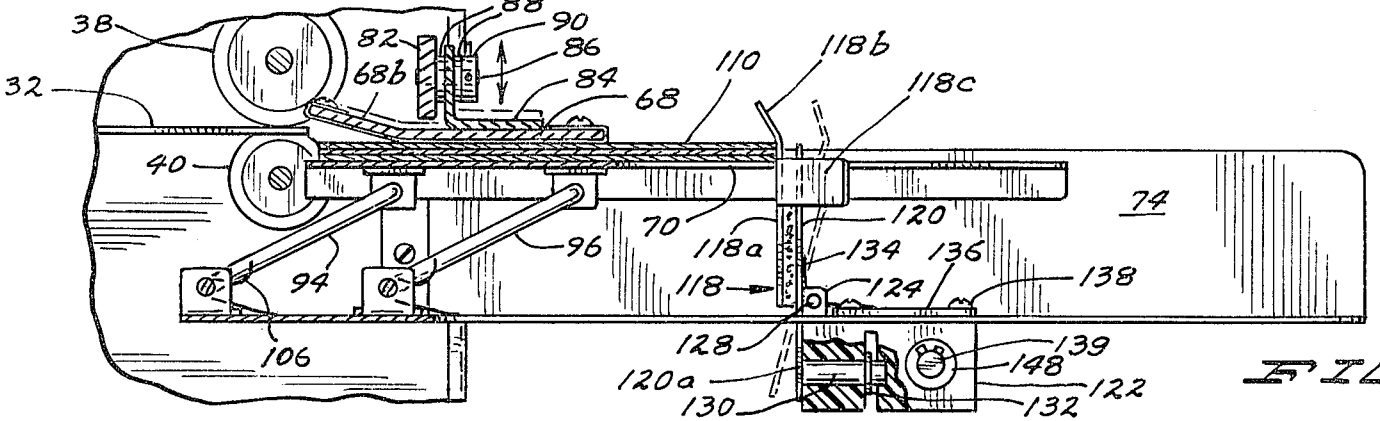
FIG. 7 is a detailed sectional view showing the print stacking device of the present invention with several photographic prints being held in stacked relationship between the upper foot element and the lower platform element.

FIGS. 6 and 7 illustrate the operation of the print stacker of the present invention. In FIG. 6, foot element 68 and platform 70 are shown in their rest positions before any prints have been stacked. It can be seen that the lower surface of foot element 68 is positioned slightly below the discharge plane for the prints as defined by drive rollers 38, idler rollers 40, and conveyor bed 32. The upper surface of lower platform 70 is also positioned slightly below the lower surface of conveyor bed 32. In this rest position, wear strips 78 on the bottom surface of foot element 68 are in contact with the top surface of platform 70.

In FIG. 7, three photographic prints 110 have been deposited between foot element 68 and platform 70. As shown in FIG. 7, as each print is added to the top of the stack of prints held between platform 70 and foot element 68, platform 70 moves slightly downward. Due to parallel arms 94 and 96, platform 70 remains generally parallel to the planar surface of foot element 68 as it moves downward with additional prints 110.

As each new print reaches the discharge end of the conveyor system and is driven by drive rollers 38 and idler rollers 40, its front edge first engages the inclined deflecting portion 68*a* of foot element 68. As a result, the front edge of the print is deflected downward onto platform 70 or the top print of the stack, as the case may be. Stop element 72 is positioned with respect to the discharge end and to inclined deflecting portion 68*a* so that the drive rollers 38 drive the print until the front edge of the print has almost reached stop element 72. The momentum of the print carries it forward until its front edge engages stop element 72. As shown in FIG. 7, this causes the rear edges of prints 110 to be stacked essentially in alignment in a position very close to the discharge end of the conveyor system. It can also be seen from FIG. 7 that the rear edges of the already stacked prints are positioned below the plane defined by conveyor bed 32 and rollers 38 and 40, so that the rear edges of the already stacked prints will not interfere with the front edge of the next print to be stacked.

In the present invention, the photographic prints are under a positive drive condition throughout their entire travel through the sorting and conveying mechanism and into the stacking mechanism. The only free travel of the prints is after the final drive rollers 38 have driven out of contact with the rear edge of the print. As illustrated in FIG. 7, the print travels only a very short distance after leaving contact with drive rollers 38—i.e. the distance until the front edge of print 110 contacts stop element 72. Even during this time, the prints are being held between foot element 68 and platform 70.

It can also be seen that the movement of both foot element 68 and platform 70 permits each print 110 to be driven onto the top of the stack with a minimum of interference. Foot element 68 moves up and down due to slotted openings 92, and also rocks slightly. As a result, as each print 110 is driven between foot element 68 and platform 70, foot element 68 first tends to move upward, and then the combined weight of foot element 68 and prints 110 causes platform 70 to move downward against the spring force of torsion springs 106 and 108.

In order to maintain complete control over the print throughout the entire conveying and stacking operation, the final drive rollers 38 or 60 have accompanying idler rollers 40 or 62, respectively. This differs from the conveyor apparatus shown in U.S. Pat. No. 4,114,349, in which the final drive roller merely acts in cooperation with the conveyor bed to drive the prints into a collecting station. In the present invention, it has been found that adjustment of the drive rollers can be extremely critical unless idler rollers 40 or 62 are used. It is important that the print be prevented from moving laterally during the final stacking operation, since this would result in a staggered or uneven stack of prints. This lateral movement can occur during the final driving of the prints between foot element 68 and platform 70 if only drive rollers 38 or 60 are used, due to variations in drive pressure and slippage and the variations in drive roller diameter between the two drive rollers on each drive shaft. This tendency to move laterally is not a problem in the remainder of the conveyor system because at any time the print is always being driven by more than one set of rollers, because successive sets of rollers are spaced apart by a distance which is less than the minimum length of the prints. The addition of idler rollers 40 and 62, therefore, eliminates the tolerance problems and minimizes the tendency of the prints to move laterally due to variations in drive pressure and drive diameter of the final drive rollers 38 or 60.

As shown in the Figures, print tray base 74 is stationary and generally positioned below movable platform 70. In addition to providing the base from which platform 70 is supported, print tray base 74 provides several other important features. First, it defines a lower limit of movement of platform 70, and therefore a maximum number of prints which can be stacked between foot element 68 and platform 70. Second, print tray base 74 has an upstanding side wall 74*a* which provides a limit to the lateral movement of the prints in the stacking mechanism. Third, the horizontal portion of print tray base 74 has three parallel slots 112, 114 and 116 (best shown in FIG. 5) which guide movable stop element 72.

Movable stop element 72 includes an upstanding stop member 118 having a print stopping portion 118*a*, a slightly inclined top portion 118*b*, and an outwardly extending handle portion 118*c*. Located immediately behind stop member 118 is an upstanding support member 120, to which stop member 118 is mounted. Members 118 and 120 are generally parallel to one another, and, in their normal position, are both essentially vertically oriented.

Mounting block 122 is positioned below film tray base 74, but has two upstanding posts 124 and 126 which extend upward through slots 112 and 116, respectively, in film tray base 74. Pivot pin 128, which is held by posts 124 and 126, pivotally connects support member 120 with mounting block 122.

As stated previously, the normal position of stop member 118 and support member 120 is in the generally upstanding position in order to stop the forward travel of the front edges of the prints as they are deposited between foot element 68 and platform 70. Stop element 118 must be relatively rigid and strong enough to stop the prints without significant movement itself.

In the present invention, stop member 118 is held sufficiently rigid in its upstanding position to stop prints, while also being pivotable (as illustrated in phantom in both FIGS. 6 and 7) to move out of the way when the operator is removing the stacked prints representing a customer order. In the present invention, member 120 has a downwardly extending narrower portion 120*a* which extends downward through opening 114 in base 74. Member 120 is a ferrous material, and downwardly extending portion 120*a* is normally held in vertical position by permanent magnet 130. The strength of magnet 130, which is held in position in mounting block 122 by retaining ring 132, is sufficient to hold stop member 118 and support member 120 in vertical position against the force of a forwardly moving print.

When the operator desires to remove prints from the stacking mechanism, he grasps handle portion 118*c* and pivots members 118 and 120 downward about a pivot axis defined by pivot pin 128. The force applied by the operator to handle 118*c* is sufficient to overcome the magnetic attraction between magnet 130 and downwardly extending portion 120*a* of member 120.

After the prints have been removed, the operator lets go of handle 118*c*, and torsion spring 134 applies a spring force to member 120 which returns it to an upstanding position. In the upstanding position, lower portion 120*a* is again held by the magnetic field from permanent magnet 130. In other words, stop member 118 is normally magnetically latched in an upright position but is pivotable downward out of the way when prints are to be removed. It is also spring loaded so that it returns to the magnetically latched position after the prints have been removed.

Stop element 72 is movable with respect to the discharge end of the conveyor system so that the stacking mechanism can accommodate different length prints. As best shown in FIGS. 5–8, mounting block 122 of stop element 72 is connected to plate 136 by screws 138, which extend through slots 112 and 116 of tray base 74. As in FIG. 8, horizontal pin 139 passes through mounting block 122 and carries vertical pin 140. Vertical pin 140 is a locking pin which is received in notches 142 along the side of slot 116 in print tray base 74. Spring 144 on pin shaft 139 acts against the side wall of mounting block 122 and retaining ring 146 to normally urge and hold vertical pin 140 in one of the notches 142 of slot 116. The position of print stop element 72 may be changed by grasping and pulling knob 148, which is mounted on the opposite end of horizontal pin 139 from spring 144. This pulls vertical pin 140 out of engagement with a notch 142 and permits print stop element 72 to be moved freely along the path defined by slotted openings 112, 114 and 116. When the new position of the stop element 72 is reached, knob 148 is released and vertical pin 140 is permitted to come into engagement with another notch 142.

Platform 70 of the present invention preferably has a wider section nearest the discharge end of the conveyor system and a narrower portion which extends forward to provide support along one edge of the prints. The shape of platform 70 is particularly advantageous for several reasons. First, it permits stop element 72 to be mounted on tray base 74, rather than on platform 70. As a result, torsion springs 106 and 108 do not have to support the additional weight of a print stop on platform 70.

Second, the configuration of platform 70 permits the operator to grasp the stack of prints both on top and below the prints without any interference from platform 70. This is because platform 70 only supports the prints on a portion of their entire area.

In conclusion, the print stacking apparatus of the present invention produces uniform stacks of photographic prints which can be easily removed by the operator and placed into a customer's order envelope. Unlike the prior art stacking devices, additional alignment of the prints manually by the operator is not normally necessary.

The precise stacking and alignment of the prints in the print stacker of the present invention is achieved by maintaining positive control over the prints throughout the conveying and during nearly all of the delivery of the prints from the discharge end of the conveyor to their final stacking position.

Although the present invention has been described with reference to preferred embodiments, workers skilled in the art will recognize that changes may be made in form and detail without departing from the spirit and scope of the invention.

What is claimed is:

1. A photographic print stacking device for use with a system having a discharge end from which photographic prints are discharged, the photographic print stacking device comprising:

a receiving platform positioned slightly below and extending outwardly from the discharge end with an upper surface on which prints are stacked, the platform being movable downward as prints are stacked thereon;

a floating foot element disposed above the receiving platform in generally opposed relation thereto with a lower surface thereof lying in a plane parallel to the upper surface of the receiving platform while keeping an essentially continuous downward force across essentially the entire transverse width of the photographic prints being stacked on the receiving platform, the floating foot element having deflecting means positioned proximate the discharge end to guide the photographic prints downwardly between the foot element and the receiving platform and being adapted to move upwardly in response to engagement by the photographic prints discharged from the conveyor system, to facilitate movement of the prints between the lower surface and the platform;

means for maintaining the receiving platform in substantially parallel relation to and below the delivery plane and for yieldably urging the receiving platform toward the floating foot element; and stop means for stopping prints as they are deposited between the receiving platform and the floating foot element and for maintaining the prints in a predetermined stacked relationship.

2. The print stacking device of claim 1 wherein the receiving platform moves away from the floating foot element as additional prints are stacked between the receiving platform and the floating foot element.

3. The prints stacking device of claim 2 wherein the means for yieldably urging the receiving platform and the floating foot element toward one another applies a force to the receiving platform to urge it toward the floating foot element.

4. The print stacking device of claim 1 and further comprising:

a base extending parallel to and below the receiving platform.

5. The print stacking device of claim 4 wherein the means for maintaining the receiving platform comprises:

parallelogram linkage members connected to the base and to the receiving platform; and spring means for urging the parallelogram linkage members in a direction which causes the receiving platform to move toward the floating foot element.

6. The print stacking device of claim 5 wherein the parallelogram linkage members comprise a plurality of parallel arms pivotally connected to the base and pivotally connected to the receiving platform.

7. The print stacking device of claim 4 wherein the stop means is supported by the base.

8. The print stacking device of claim 7 wherein the base has slot means and wherein the stop means is movable along the slot means.

9. The print stacking device of claim 8 wherein the slot means has a plurality of positioning notches and wherein the stop means includes a spring loaded locking pin assembly for normally engaging one of the positioning notches and holding the stop means in a selected position along the slot means, and being disengageable from the positioning notches to permit adjustment of position of the stop means along the slot means.

10. The print stacking device of claim 7 wherein the stop means comprises:

mounting means for connecting the base and the stop means;

a print stop member pivotally connected to the mounting means, the print stop member having an upstanding position for engaging and stopping prints; and magnetic latch means for holding the print stop member in its upstanding position and being capable of releasing the print stop member to permit pivoting of the print stop member from the upstanding position to permit removal of prints from between the receiving platform and the floating foot element.

11. The print stacking device of claim 10 wherein the stop means further comprises:

spring means for causing the print stop member to pivot toward the upstanding position.

12. The print stacking device of claim 1 wherein the receiving platform comprises a platform having a first portion proximate the discharge end which has a width sufficient to support prints across essentially their entire width and having a second portion forward of the first portion which has a width which is less than the width of prints for supporting the prints along one longitudinal edge, thereby permitting removal of a stack of prints by grasping both the top and bottom prints of the stack without interference from the second portion of the platform.

13. A photographic print stacking device comprising:

conveying means for conveying photographic prints, the conveying means having a discharge end at which photographic prints are discharged;

upper and lower print receiving elements positioned proximate the discharge end to receive and hold prints therebetween, the lower print receiving element being movable generally downward and away from the upper print receiving element as prints are deposited on the lower print receiving element, the lower print receiving element having a first portion with an upper surface positioned proximate the discharge end which has a width sufficient to support prints across essentially their entire transverse width and having a second portion extending from the first portion having a width less than the width of prints for supporting the prints along one longitudinal edge, the upper print receiving element overlying essentially the entire transverse width of the first portion of the lower print receiving element with a lower surface of the upper print receiving element essentially parallel to the upper surface of the lower print receiving element and the upper print receiving element applying an essentially continuous downward force on the lower print receiving element and across essentially the entire width of the prints therebetween;

means for yieldably urging the lower print receiving element upward toward the upper print receiving element;

stop means for stopping leading edges of prints at a selected location from the discharge end as they are deposited in stacked relation on the lower print receiving element with their trailing edges substantially in alignment at a location proximate the discharge end, the stop means extending upwardly above the second portion of the lower print receiving element and being movable horizontally generally parallel to one longitudinal edge of the second portion; and deflecting means positioned beyond the location of the trailing edges and above the lower print receiving element for deflecting the prints generally downward toward the lower print receiving element to deposit the prints in stacked relation between the upper and lower print receiving elements.

14. The photographic print stacking device of claim 13 wherein the lower print receiving element comprises a receiving platform and wherein the upper receiving element comprises a floating foot element.

15. The photographic print stacking device of claim 14 wherein the conveying means defines a discharge plane at the discharge end and wherein the plane established by the platform with no photographic prints thereon is disposed slightly below the discharge plane.

16. The print stacking device of claim 15 wherein the deflecting means comprises an inclined deflecting portion of the floating foot element positioned proximate the discharge end of the conveying means for deflecting the prints generally downward toward the platform.

17. The print stacking device of claim 16 and further comprising:

base means positioned below and generally parallel to the platform.

18. The print stacking device of claim 17 wherein the means for yieldably urging the lower print receiving element upward comprises:

a plurality of parallel arms pivotally connected to the base means and pivotally connected to the platform; and spring means for urging the parallel arms in a direction which causes the platform to move generally upward toward the floating foot element.

19. The print stacking device of claim 17 wherein the stop means is supported by the base means.

20. The print stacking device of claim 19 wherein the stop means includes a generally upstanding stop member which is pivotally mounted to facilitate removal of stacked photographic prints from the platform.

21. A photographic print stacking device comprising:

conveying means for conveying photographic prints, the conveying means having a discharge end at which photographic prints are discharged, the conveying means including a plurality of drive rollers on a common drive shaft positioned proximate the discharge end, and a plurality of idler rollers on a common shaft opposing the drive rollers to drive photographic prints therebetween;

a receiving platform positioned proximate the discharge end to receive prints;

a floating foot element disposed above the receiving platform in generally opposed relation thereto, the floating foot element having notches therein proximate the discharge end for permitting the floating foot element to surround partially the plurality of drive rollers;

means for yieldably urging the first and second print receiving elements toward one another; and stop means for stopping prints as they are deposited between the first and second print receiving elements.

22. A photographic print stacking device comprising:

conveying means for conveying photographic prints, the conveying means having a discharge end at which photographic prints are discharged and defining a delivery plane;

base means positioned below and generally parallel to the delivery plane;

a receiving platform positioned below the delivery plane and extending from the discharge end of the conveying means and generally parallel to and above the base, the receiving platform having a first portion with an upper surface positioned proximate the discharge end which has a width sufficient to support prints across essentially their entire transverse width and having a second portion extending from the first portion and having a width less than the width of the prints for supporting the prints along one longitudinal edge;

a floating foot element disposed above the first portion of the platform, the floating foot element having a first inclined portion nearest the discharge end guiding the photographic prints to a second portion with a lower surface essentially parallel to the upper surface of the receiving platform providing an essentially continuous downward force across essentially the entire transverse width of the photographic prints;

means for yieldably urging the receiving platform generally upward toward the floating foot element, while permitting the receiving platform to move downward as prints are stacked between the platform and the floating foot element;

means for maintaining the platform in substantially parallel relation to the base; and stop means connected to the base and extending upward to a position above the platform to stop prints as they are deposited between the floating foot element and the platform.

23. The photographic print stacking device of claim 22 wherein the means for maintaining comprises a plurality of parallel arms pivotally connected to the base means and pivotally connected to the platform, and wherein the means for yieldably urging the receiving platform comprises spring means for urging the plurality of parallel arms in a direction which causes the platform to move generally upward toward the floating foot element.

24. The photographic print stacking device of claim 22 wherein the base means has slot means and wherein the stop means is movable along the slot means.

25. The print stacking device of claim 24 wherein the slot means have a plurality of positioning notches and wherein the stop means includes a spring loaded locking pin assembly for normally engaging one of the positioning notches and holding the stop means in a selected position along the slot means, and being disengageable from the positioning notches to permit adjustment of position of the stop means along the slot means.

26. The photographic print stacking device of claim 22 wherein the floating foot element has an inclined portion proximate the discharge end for deflecting prints downwardly between the floating foot element and the platform.

27. A photographic print stacking device comprising:

a conveyor system having a discharge end from which photographic prints are discharged;

first and second print receiving elements positioned proximate the discharge end to receive and hold prints therebetween;

means for yieldably urging the first and second print receiving elements toward one another;

a base parallel to the second print receiving element; and stop means for stopping prints as they are deposited between the first and second print receiving elements and being movably attached to the base, the stop means having a print stop member with a lower portion and with an upper portion for engaging and stopping prints when in an upstanding position, mounting means for mounting the stop means at a selected position with respect to the discharge end, connecting means for pivotally connecting the stop member between the upper and lower portion to the mounting means, spring means for causing the print stop member to pivot toward the upstanding position, and magnetic latch means below the connecting means for holding the stop member in its upstanding position by magnetically engaging the lower portion of the stop member and being capable of releasing the stop member to permit pivoting of the stop member to permit removal of prints from between the first and second print receiving elements.

28. A combined conveyor and stacking device for photographic sheet products comprising:

a conveyor system having a discharge end at which photographic sheets are discharged and including means defining a delivery plane and a drive roller system having the rollers thereof disposed tangentially of the delivery plane;

a receiving platform positioned slightly below the delivery plane and extending outwardly from the discharge end of the conveyor system for receiving photographic sheets on an upper surface;

means for maintaining the platform in substantially parallel relation to and below the delivery plane;

a floating foot element disposed above the platform in generally opposed relation thereto with a lower surface thereof lying in a substantially parallel plane to the upper surface surface of the receiving platform while keeping an essentially continuous downward force across essentially the entire transverse width of the photographic prints being received by the receiving platform, the floating foot element having an inclined guide portion to guide the photographic sheets downwardly between the foot element and the platform and being adapted to move upwardly in response to engagement by the photographic sheets discharged from the conveyor system, to facilitate movement of the sheets between the lower surface and the platform;

means for yieldably urging the receiving platform toward the floating foot element and permitting the receiving platform to move downward as prints are stacked between the platform and the floating foot element; and stop means for maintaining the photographic sheets in predetermined stacked relationship.

* * * * *

UNITED STATES PATENT OFFICE

CERTIFICATE OF CORRECTION

Patent No. 4,260,148 Dated April 7, 1981

Inventor(s) Robert E. Diesch and Charles L. Euteneuer

It is certified that error appears in the above-identified patent and that said Letters Patent are hereby corrected as shown below:

Front page of patent document, Item [75], "Charles L. Eutenuer" should read --Charles L. Euteneuer-- .

Signed and Sealed this

*Fifteenth* Day of *September 1981*

[SEAL]

*Attest:*

GERALD J. MOSSINGHOFF

*Attesting Officer* *Commissioner of Patents and Trademarks*